US009284821B1

(12) United States Patent
Albertson

(10) Patent No.: US 9,284,821 B1
(45) Date of Patent: Mar. 15, 2016

(54) MULTILATERAL WELL SYSTEM AND METHOD

(71) Applicant: Allan Albertson, Calgary (CA)

(72) Inventor: Allan Albertson, Calgary (CA)

( * ) Notice: Subject to any disclaimer, the term of this patent is extended or adjusted under 35 U.S.C. 154(b) by 0 days.

(21) Appl. No.: 14/676,150

(22) Filed: Apr. 1, 2015

Related U.S. Application Data

(63) Continuation of application No. 14/634,943, filed on Mar. 2, 2015.

(51) Int. Cl.

| | |
|---|---|
| ***E21B 7/06*** | (2006.01) |
| ***E21B 29/06*** | (2006.01) |
| ***E21B 41/00*** | (2006.01) |
| ***E21B 33/14*** | (2006.01) |
| *E21B 33/10* | (2006.01) |

(52) U.S. Cl.
CPC ..... *E21B 41/0042* (2013.01); *E21B 33/14* (2013.01); *E21B 7/061* (2013.01); *E21B 29/06* (2013.01); *E21B 2033/105* (2013.01)

(58) Field of Classification Search
CPC .. E21B 7/061; E21B 41/0035; E21B 41/0042
See application file for complete search history.

(56) References Cited

U.S. PATENT DOCUMENTS

| | | | | |
|---|---|---|---|---|
| 2,858,107 | A * | 10/1958 | Colmerauer | 166/255.2 |
| 5,423,387 | A | 6/1995 | Lynde | |
| 5,431,219 | A | 7/1995 | Leising et al. | |
| 5,832,997 | A * | 11/1998 | White | 166/117.6 |
| 6,047,774 | A * | 4/2000 | Allen | 166/313 |
| 6,056,059 | A * | 5/2000 | Ohmer | 166/313 |
| 6,135,208 | A * | 10/2000 | Gano | 166/313 |
| 6,712,144 | B2 | 3/2004 | Buytaert | |
| 2002/0023754 | A1 | 2/2002 | Buytaert | |
| 2004/0168809 | A1 * | 9/2004 | Nobileau | 166/313 |
| 2004/0244992 | A1 * | 12/2004 | Carter | 166/380 |
| 2005/0173121 | A1 | 8/2005 | Steele et al. | |
| 2005/0241834 | A1 * | 11/2005 | McGlothen | 166/380 |
| 2009/0008078 | A1 * | 1/2009 | Patel | 166/50 |

* cited by examiner

*Primary Examiner* — Robert E Fuller

(74) *Attorney, Agent, or Firm* — Maxey Law Offices, PLLC; Stephen Lewellyn

(57) ABSTRACT

A method of forming a sealed junction between wellbores includes first enlarging a length of a first wellbore to form an enlarged wellbore segment. Then installing casing in the first wellbore and in the enlarged wellbore segment. After the casing is installed, material is pumped into the enlarged wellbore segment and allowed to harden to form a hardened material. After hardening, the first wellbore is reestablished. And then a second wellbore is formed by drilling out a lateral passage through the casing and the hardened material. A liner is then run into the second wellbore with an end of the liner covered with a swellable elastomer. The swellable elastomer is allowed to expand and seal against the surface of the lateral passage forming a sealed junction between the first wellbore and the second wellbore.

10 Claims, 5 Drawing Sheets

MULTILATERAL WELL SYSTEM AND METHOD

FIELD OF THE INVENTION

The present invention relates generally to multilateral wells, and more particularly, relating to a method for forming a full bore sealed junction between a lateral well and primary borehole and a multilateral well system with full bore sealed junctions.

BACKGROUND OF THE INVENTION

Multilateral well systems are well known in the oil and gas industry. Generally, a multilateral well system includes a primary wellbore formed through a formation and one or more lateral wells that extend from the primary wellbore into the adjacent formation. Multilateral well systems enjoy several advantages, including, among others, higher production indices, which increases profitability on low producing wells.

While multilateral well systems enjoy certain advantages, they suffer from several problems that have plagued the industry. In particular, drilling and completing a multilateral well system presents several problems, including sealing the junction between the laterally formed wellbore and the primary wellbore. Without a good seal between the lateral and primary wellbores, the junction is highly prone to leaking, causing a host of problems. For instance, an improperly sealed junction may not allow effective zone isolation, which is an important component to well completion. And an improperly sealed junction is prone to undesirable sand intrusion from unconsolidated sand surrounding the wellbore.

Several methods and systems have been developed and employed to provide reliable junction seals between the primary and lateral wellbores. While these existing systems and methods fulfill their respective, particular objectives and requirements, they are not without drawbacks. For example, many existing systems require removing a complete segment of well casing at the junction location. Removing well casing is undesirable because the formation surrounding the junction becomes unsupported by the well casing, thereby risking collapse of the formation. Additionally, many existing systems require complex and specialized well completion equipment and, further, prevent full well casing drift.

Accordingly, a need remains for a new multilateral well system and method that provides a reliable junction seal without removing well casing and that maintains full well casing drift.

SUMMARY OF THE INVENTION

Embodiments of the present invention provide a multilateral wellbore system and method that solves the problem of sealing the junction between two wellbores without jeopardizing formation integrity and while providing full casing drift across the junction.

In general, in one aspect, a method of forming a junction between wellbores is provided. The method comprising the steps of:

a) enlarging a length of a first wellbore to form an enlarged wellbore segment;
b) installing casing in the first wellbore and in the enlarged wellbore segment;
c) pumping material into the enlarged wellbore segment and allowing the material to harden to form a hardened material;
d) reestablishing the first wellbore; and e) forming a second wellbore by drilling out a lateral passage through the casing and the hardened material.

In general, in another aspect, a method of forming a multilateral well system is provided. The method comprising the steps of:

a) drilling a first wellbore through a formation;
b) enlarging a length of the first wellbore to form an enlarged wellbore segment;
c) installing casing in the first wellbore and in the enlarged wellbore segment with the casing being disposed eccentrically within the enlarged wellbore segment;
d) pumping material into the enlarged wellbore segment and allowing the material to harden to form a hardened material having a thickness greater along one side of the casing than an opposite side of the casing;
e) reestablishing the first wellbore; and
f) forming a second wellbore by drilling out a lateral passage through the casing and though the greater thickness of the hardened material.

In general, in yet another aspect, a sealed junction between a first wellbore and a second wellbore is provided. The sealed junction includes an enlarged wellbore segment of the first wellbore. A casing is disposed within and along both the first wellbore and the enlarged wellbore segment. A hardened material is disposed in and fills the enlarged wellbore segment and encircles the casing. A lateral passage extends through both the casing and the hardened material and joining the second wellbore with the first wellbore. A liner is disposed within the lateral passage and the second wellbore. And a swellable elastomer is disposed along a length of the liner that is disposed within the lateral passage. The swellable elastomer is expand and makes sealing contact with the surface of the lateral passage, thereby sealing the first wellbore from the second wellbore.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
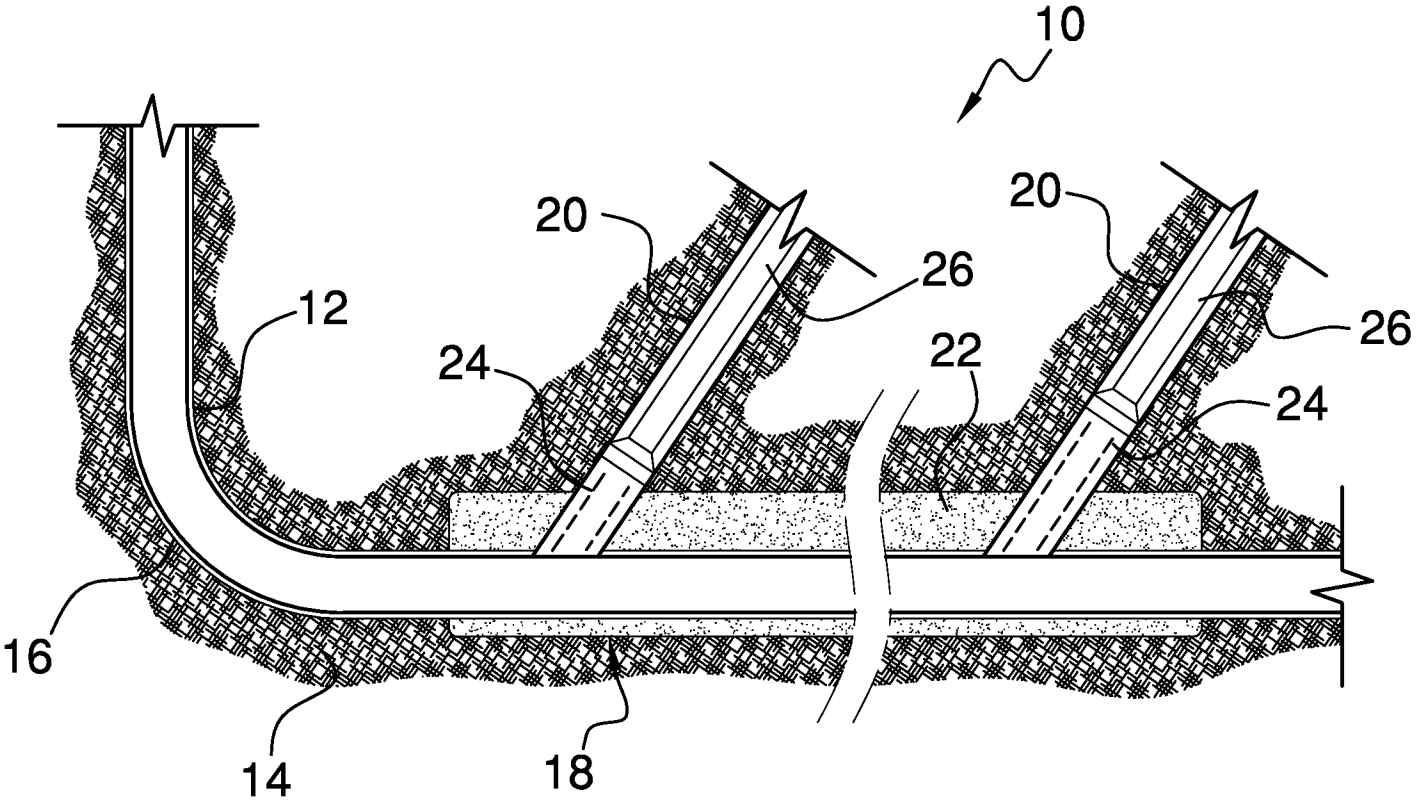
FIG. 1 is a diagrammatic view of a multilateral wellbore system in accordance with an embodiment of the principles of the present invention.
Figure 2:
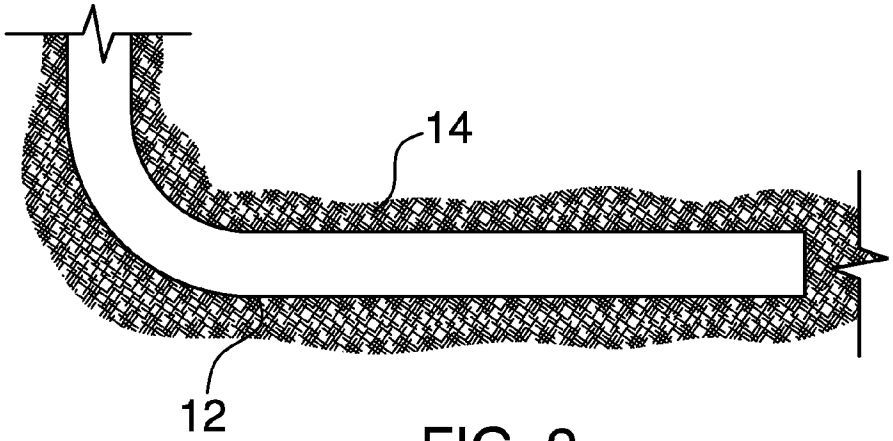
FIG. 2 is a diagrammatic view of section of a primary wellbore that has been drilled in a formation and that is not lined with casing.

Initially, with reference to FIG. 1, a multilateral well system constructed in accordance with an embodiment of the present invention is representatively illustrated and designated reference number 10. Multilateral well system 10 includes a deviated or horizontal wellbore 12 formed in formation 14 with casing 16 run through the wellbore. Wellbore 12 includes an enlarged wellbore segment 18 along a portion of the wellbore having one or more lateral wellbores 20. Wellbore segment 18 is filled with a hard, non-porous material 22, such as, for example, fiber reinforced casing cement. Each lateral wellbore 20 extends through casing 16 and material 22. Each lateral wellbore 20 is fluidically sealed at the junction between the lateral wellbore and primary wellbore 12 by an open hole swell packer 24 that positively seals against the sidewall of the lateral wellbore along the portion extending through the casing 16 and material 22. Additionally, packer 24 fluidically connects the lateral wellbore liner 26 to casing 16. The interface surface provided by casing 16 and material 22, disposed within wellbore segment 18, along the lateral wellbore and the swell packer 24 provides a full bore sealed junction between the lateral wellbore and the primary wellbore 12 that has never been realized here before.

With reference to FIGS. 2-9, a method, in accordance with an embodiment of the invention, of forming the multilateral well system 10 is illustrated and will be described. Beginning with FIG. 1, primary wellbore 12 is drilled, using conventional methods, through formation 14 at a desired location within the formation.

Figure 3:
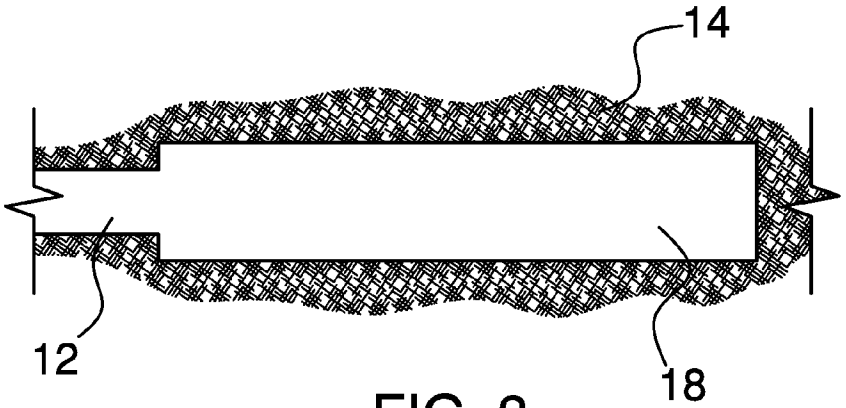
FIG. 3 is a diagrammatic view of a section primary wellbore having a segment of its length enlarged.

Turning to FIG. 3, after wellbore 12 drilled, enlarged wellbore segment 18 is created by under-reaming wellbore 12 along a length of the wellbore where a lateral wellbore kick off is desired (e.g., at a junction between the primary wellbore and a lateral wellbore). Wellbore segment 18 has a diameter that is greater than the diameter of wellbore 12 that is determined as a function of the diameter of the wellbore and the diameter of a liner that is intended to be run into the lateral. In an aspect, the diameter of enlarged wellbore segment 18 is at least twice the diameter of wellbore 12 to ensure that the diameter of wellbore segment 18 is sufficiently larger than the diameter of wellbore 12.

Figure 4:
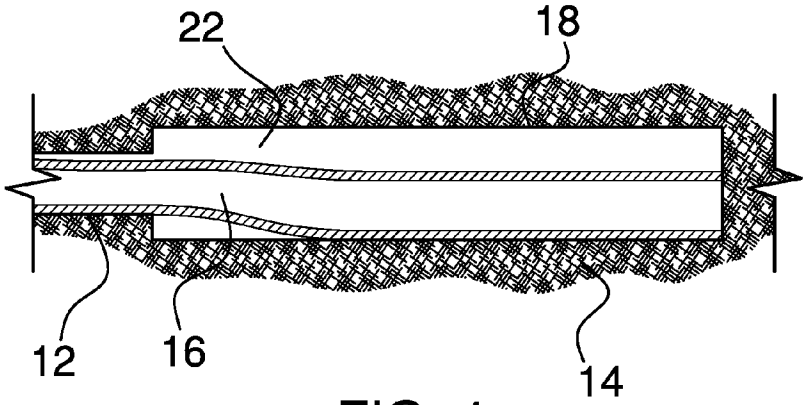
FIG. 4 is a diagrammatic view of a section of a primary wellbore having a casing disposed along and within both the primary wellbore and the enlarged wellbore segment and hardened material filling the enlarged wellbore segment.
Figure 5:
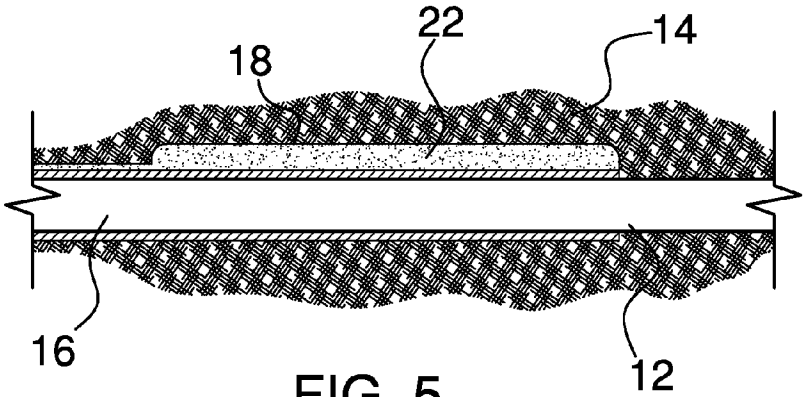
FIG. 5 is a diagrammatic view of a section of a primary wellbore that has been reestablished after filling the enlarged wellbore segment with material.

Referring now to FIG. 4, after under-reaming wellbore 12 to form enlarged wellbore segment 18, well casing 16 is run into the wellbore and through the enlarged wellbore segment with the well casing positioned toward the bottom of the enlarged wellbore segment. Afterward, the enlarged wellbore segment 18 is filled with material 22, which is pumped into the enlarged wellbore segment. Following, the wellbore 12 is reestablished by drilling out to complete a leg portion of the well system, as best seen in FIG. 5.

In an aspect, material 22 is preferably a non-porous material when it hardens, such as, for example, fiber reinforced well casing cement. In an application, the fiber reinforced well casing cement is conventional API Class G cement that is mixed with one or more additives to increase the tensile and flexural strength of the cement. In an embodiment, the additives are selected from glass fiber, carbon fiber, or a combination of both.

Figure 6:
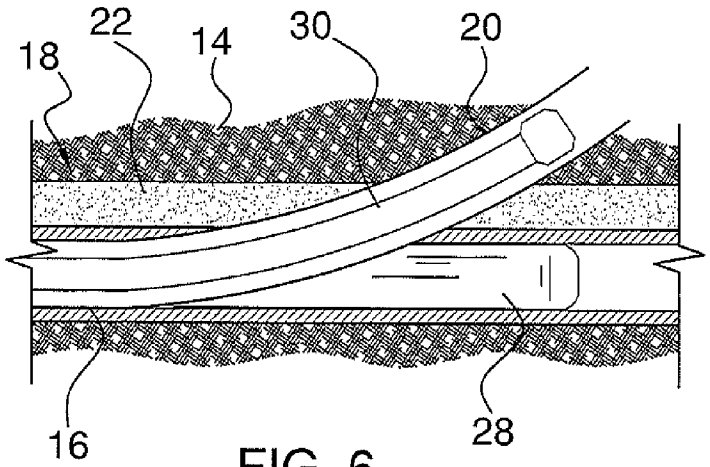
FIG. 6 is a diagrammatic view of a section of a primary wellbore showing drilling through the casing and hardened material and forming a lateral wellbore extending from the primary wellbore.
Figure 7:
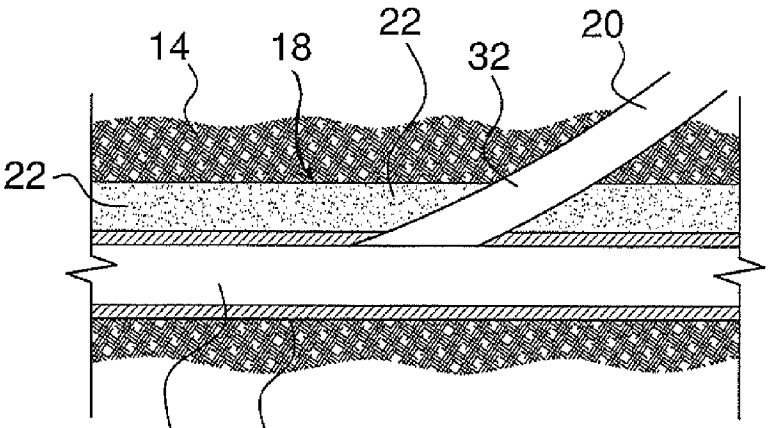
FIG. 7 a diagrammatic view of a section of a primary wellbore showing a junction between the primary wellbore and the second wellbore after the second wellbore is drilled.

Turning now to FIG. 6, after the wellbore 12 is drilled out, a whipstock 24 is run into casing 16 and positioned at a desired location along the casing such that a lateral wellbore will have a joint within material 22. Following placement of whipstock 24, drill string 30 is run into the casing 16 and directed by the whipstock 24 to drill lateral wellbore 20 through the casing, material 22, and into the surrounding formation 14. FIG. 7 illustrates the well system following drilling the lateral wellbore 20. Specifically, the wellbore 20 forms a passage 28 through casing 16 and material 22. As discussed further below, passage 32 provides a sealing surface of the sealed junction.

Figure 8:
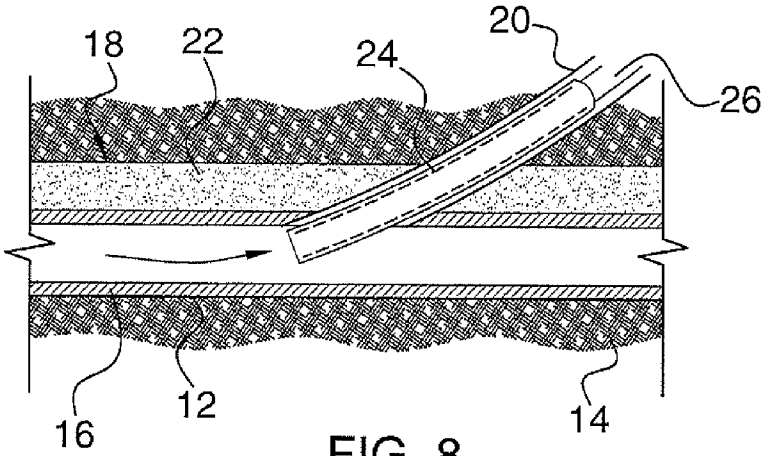
FIG. 8 is a diagrammatic view of a liner disposed within the second wellbore and across the junction between the primary wellbore and the second wellbore with the liner fitted with a swellable elastomer that is similarly disposed across the junction.

Turning now to FIG. 8, after drilling wellbore 20, liner 26 is run through casing 16 and into wellbore 20. The Surface-side end of the liner 26 is either wrapped with a swellable elastomer 24 along a sufficient length so as to extend completely across passage 32 and into the open hole wellbore 20. An example of a suitable swellable elastomer is FastSwell™ available from TAM International. Alternative swellable elastomers would be readily recognized by one of ordinary skill in the art. Alternatively, the liner 26 could be fitted with an open hole swellable packer, such as, for example, FREECAP™ type packers available from TAM International. Again, alternative packers would be readily recognized by one of ordinary skill in the art.

With continued reference to FIG. 8, the liner 26 is run it to a position such that the swellable elastomer (packer) 24 is disposed completely across the opening through casing 16, the hardened material 22, and partially along open bore hole 20.

Figure 9:
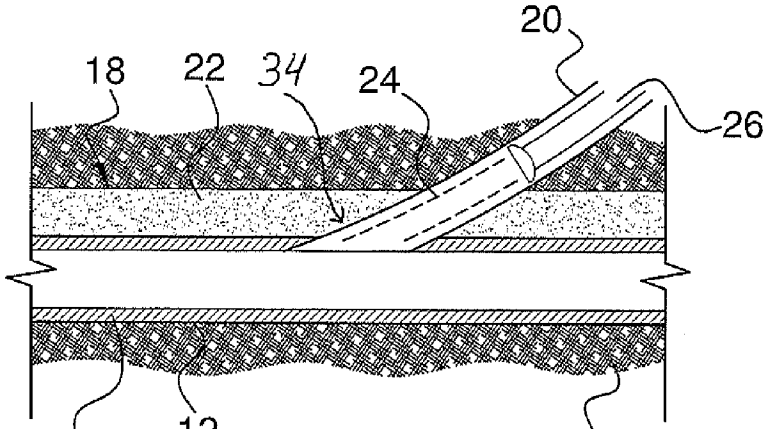
FIG. 9 is a diagrammatic view of a sealed junction between the primary wellbore and the lateral wellbore, wherein the primary wellbores enjoys full drift across the junction.

With reference to FIG. 9, once liner 26 is positioned with the swellable elastomer (packer) 24 disposed completely along passage 32, the elastomer (packer) is allowed to set against the side wall of passage 32 by expanding. Once fully expanded, a sealed junction 34 between the primary wellbore 12 and the lateral wellbore 20 is formed. After the sealed junction 34 is formed, any portion of the liner 26 extending into casing 16 is milled off, providing full drift of casing 16 at the sealed junction 34, as best seen in FIG. 9. Alternatively, the surface end of casing 16 could be pre-milled prior to running into the well to avoid having to mill the end in situ.

It is important to note that the interface surface provide by hardened material 22 along passage 32 is a stable surface that support the sealing forces of swellable elastomer (packer) 24, which insures that a high integrity seal is formed. Additionally, the formation surrounding the junction is supported by the hardened material 22 and casing 16 supports, thereby preventing the formation from collapsing and impairing the sealed junction 34.

A number of embodiments of the present invention have been described. Nevertheless, it will be understood that various modifications may be made without departing from the spirit and scope of the invention. Accordingly, other embodiments are within the scope of the following claims.

What is claimed is:

1. A method of forming a junction between wellbores, said method comprising the steps of:

a) enlarging a length of a first wellbore to form an enlarged wellbore segment;

b) installing casing in said first wellbore and in said enlarged wellbore segment;

c) pumping material into said enlarged wellbore segment and allowing said material to harden to form a hardened material;

d) reestablishing said first wellbore;

e) forming a second wellbore by drilling out a lateral passage through said casing and said hardened material;

f) positioning a liner in said second wellbore with an end of said liner covered with a swellable elastomer being disposed in said lateral passage; and g) allowing said swellable elastomer to expand and seal against the surface of said lateral passage in direct contact with said casing, said hardened material, and said formation, forming a sealed junction between said first wellbore and said second wellbore.

2. The method of claim 1, further comprising the step of:

h) milling off said end of said liner within said casing so that said end of said liner does not extend into said casing.

3. The method of claim 1, wherein said step of installing further comprises disposing said casing eccentrically within said enlarged wellbore segment.

4. A method of forming a multilateral well system, said method comprising the steps of:

a) drilling a first wellbore through a formation;

b) enlarging a length of said first wellbore to form an enlarged wellbore segment;

c) installing casing in said first wellbore and in said enlarged wellbore segment with said casing being disposed eccentrically within said enlarged wellbore segment;

d) pumping material into said enlarged wellbore segment and allowing said material to harden to form a hardened material having a thickness greater along one side of said casing than an opposite side of said casing;

e) reestablishing said first wellbore by drilling through said hardened material; and f) forming a second wellbore by drilling out a lateral passage through said casing and through the greater thickness of said hardened material.

5. The method of claim 4, further comprising the steps of:

g) positioning a liner in said second wellbore with an end of said liner covered with a swellable elastomer being disposed in said lateral passage; and h) allowing said swellable elastomer to expand and seal against the surface of said lateral passage forming a sealed junction between said first wellbore and said second wellbore.

6. The method of claim 4, further comprising the step of:

i) milling off said end of said liner within said casing.

7. A sealed junction between a first wellbore and a second wellbore, said sealed junction comprising:

an enlarged wellbore segment of the first wellbore;

a casing disposed within and along both the first wellbore and said enlarged wellbore segment;

hardened material disposed in and filling said enlarged wellbore segment and encircling said casing;

a lateral passage extending through both said casing and said hardened material and joining the second wellbore with the first wellbore;

a liner disposed within said lateral passage and the second wellbore; and a swellable elastomer disposed along a length of said liner that is disposed within said lateral passage, said swellable elastomer being expanded and making sealing contact with the surface of said lateral passage in direct contact with said casing, said hardened material, and said formation, thereby sealing the first wellbore from the second wellbore.

8. The sealed junction of claim 7, wherein the portion of said casing that is disposed along said enlarged wellbore segment is eccentric to said enlarged wellbore segment.

9. The sealed junction of claim 8, wherein said hardened material has a thickness greater along one side of said casing than an opposite side of said casing at least along the portion of said casing disposed within said enlarged wellbore segment.

10. The sealed junction of claim 7, wherein said casing has full drift along a portion of said casing spanning across said passage.

* * * * *